US007557762B2

(12) United States Patent
Shimasaki et al.

(10) Patent No.: US 7,557,762 B2
(45) Date of Patent: Jul. 7, 2009

(54) ELECTRONIC APPARATUS WITH ANTENNAS

(75) Inventors: Hiroshi Shimasaki, Hamura (JP); Masao Teshima, Kunitachi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/115,876

(22) Filed: May 6, 2008

(65) Prior Publication Data

US 2008/0278384 A1 Nov. 13, 2008

(30) Foreign Application Priority Data

May 10, 2007 (JP) ..... 2007-125829

(51) Int. Cl.
*H01Q 1/24* (2006.01)

(52) U.S. Cl. ..... 343/702; 455/90.3; 361/679.55

(58) Field of Classification Search ..... 343/700 MS, 343/702, 846; 361/679.55; 455/90.3
See application file for complete search history.

(56) References Cited

U.S. PATENT DOCUMENTS 6,181,284 B1 * 1/2001 Madsen et al. ..... 343/702
6,542,131 B1 4/2003 Haapanen
6,853,336 B2 * 2/2005 Asano et al. ..... 343/702
2006/0055607 A1 * 3/2006 Satoh et al. ..... 343/702
2009/0033569 A1 * 2/2009 Motoe et al. ..... 343/702

FOREIGN PATENT DOCUMENTS

JP 04-109703 4/1992
JP 2005-198102 7/2005

* cited by examiner

*Primary Examiner*—Tan Ho
(74) *Attorney, Agent, or Firm*—Pillsbury Winthrop Shaw Pittman, LLP

(57) ABSTRACT

According to one embodiment, an electronic apparatus includes a housing in which an electrically conductive layer is formed on an inner surface of the housing, a flat-panel display which is accommodated in the housing, a first antenna which is disposed on the conductive layer, a part of the first antenna being located more on an outer peripheral side than a side of the conductive layer, and a second antenna which is disposed on the conductive layer, a part of the second antenna being located more on the outer peripheral side than the side of the conductive layer. The conductive layer includes a notch which is formed in a predetermined position of a side of the conductive layer, which is located between the first antenna and the second antenna, the notch having a length of ¼ of a wavelength corresponding to a resonance frequency of the first antenna.

9 Claims, 12 Drawing Sheets

ELECTRONIC APPARATUS WITH ANTENNAS

CROSS-REFERENCE TO RELATED APPLICATIONS

This application is based upon and claims the benefit of priority from Japanese Patent Application No. 2007-125829, filed May 10, 2007, the entire contents of which are incorporated herein by reference.

BACKGROUND

1. Field

One embodiment of the present invention relates to an electronic apparatus with wireless communication functions, such as a personal computer having antennas.

2. Description of the Related Art

In recent years, various types of portable electronic apparatuses having wireless communication functions, such as a PDA, a mobile phone and a personal computer, have been developed.

In recent years, there has been a demand for a portable electronic apparatus provided with a plurality of antennas corresponding to wireless communication functions. The antennas are provided inside the apparatus and support different wireless communication schemes. It is preferable to assemble each antenna in the housing of the portable electronic apparatus for portability.

Jpn. Pat. Appln. KOKAI Publication No. 2005-198102 discloses a communication apparatus in which two antenna elements are mounted. In order to complement electromagnetic radiation patterns of the two antenna elements, a notch is provided in a ground plane to which the two antenna elements are connected. The notch serves to adjust the position of the null point of the electromagnetic radiation pattern of one of the two antenna elements.

In KOKAI No. 2005-198102, however, no consideration is given to interference between the two antennas.

In the portable electronic apparatus, it is necessary to mount various components in a limited mounting space. Thus, the mounting antenna space is limited, and it is difficult to provide a sufficient distance between two antennas. Consequently, interference of radio waves between two antennas ("inter-antenna interference") may occur, and the performance of wireless communication may possibly deteriorate.

Therefore, it is necessary to realize a novel function which can reduce the radio wave interference between antennas.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments of the invention will now be described hereinafter with reference to the accompanying drawings. One embodiment relates to an electronic apparatus comprising a housing, a flat-panel display, a first antenna, and a second antenna. The housing contains an electrically conductive layer formed on an inner surface thereof. The flat-panel display is accommodated in the housing, with a back surface of the flat-panel display being opposed to the electrically conductive layer. The first antenna is disposed on the electrically conductive layer, and a part of the first antenna is located more on an outer peripheral side than a side of the electrically conductive layer. The second antenna is disposed on the electrically conductive layer, and a part of the second antenna is located more on the outer peripheral side than the side of the electrically conductive layer. The electrically conductive layer includes a notch (which is not limited to "V"

shape and is a cut-in portion having any desirable shape) formed in a predetermined portion of a side of the electrically conductive layer, which is located between the first antenna and the second antenna. The notch has a length of ¼ of a wavelength corresponding to a resonance frequency of the first antenna. In the present embodiment, the length of the notch is important, and the notch is not limited to any specific shape.

Figure 1:
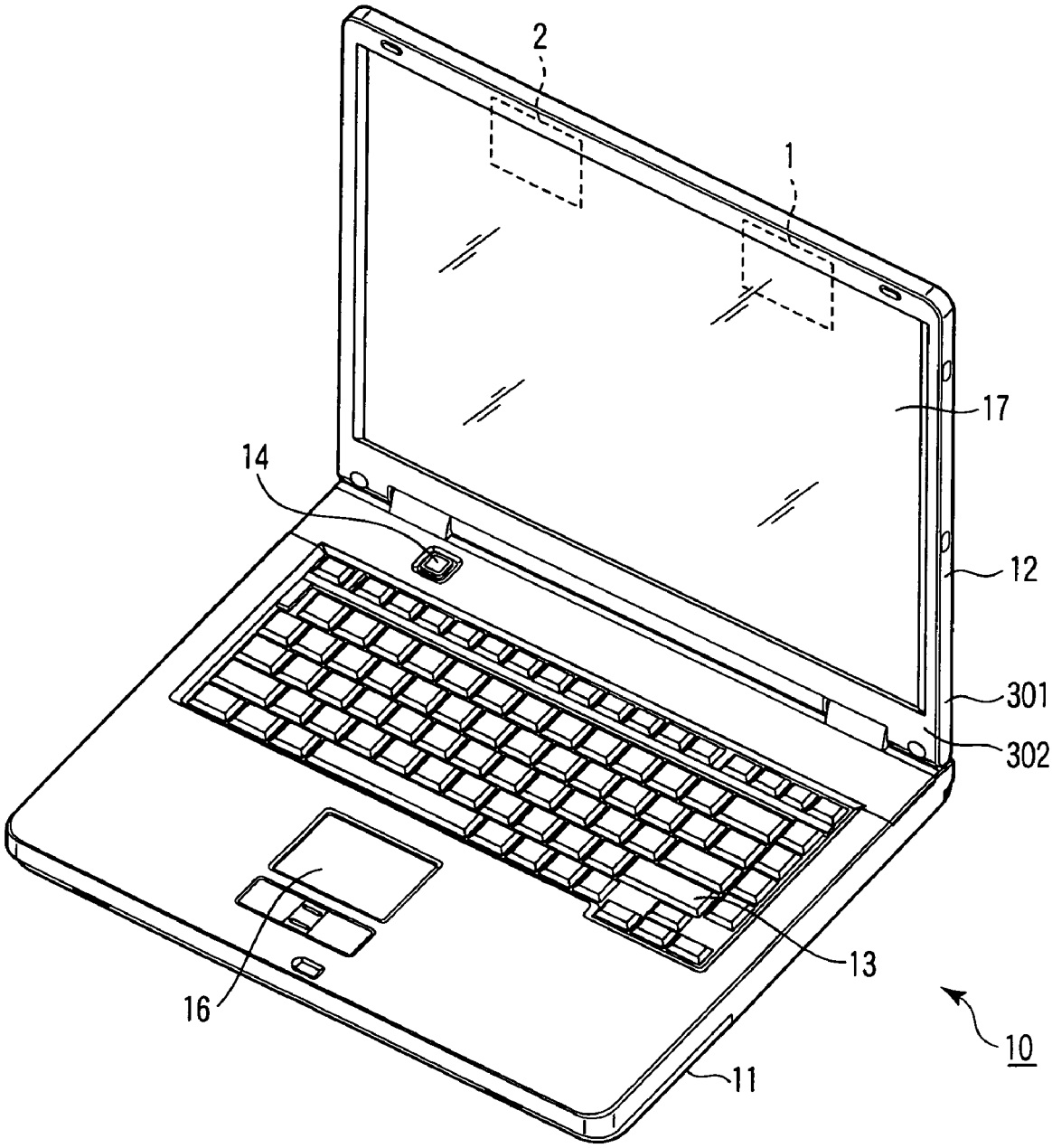
FIG. 1 is an exemplary perspective view showing an external appearance of an electronic apparatus according to an embodiment of the invention.

FIG. 1 shows an external appearance of an electronic apparatus according to the embodiment of the invention. This electronic apparatus has a function of executing wireless communication. The electronic apparatus is, for example, a portable information processing terminal such as a personal digital assistant (PDA), a mobile phone or a personal computer. In the description below, it is assumed that the present electronic apparatus is realized as a battery-powerable portable personal computer 10.

FIG. 1 is a perspective view of the computer 10 in the state in which a display unit of the computer 10 is opened. The computer 10 comprises a main body 11 and a display unit 12. A flat-panel display 17, which is composed of an LCD (Liquid Crystal Display), is accommodated in a housing 301 of the display unit 12. The housing 301 is composed of a thin box-shaped case having an opening in its upper surface. The opening in the upper surface of the housing 301 is closed by a top cover 302 having a rectangular opening in its central area, so that a display screen of the flat-panel display 17 in the housing 301 may be exposed.

Two antennas, namely, a first antenna 1 and a second antenna 2, for wireless communication system are built in the housing 12.

The display unit 12, which is provided on the main body 11, is rotatable between an open position, where the upper surface of the main body 11 is exposed, and a closed position, where the upper surface of the main body 11 is covered with the display unit 12.

The main body 11 has a thin box-shaped casing. A keyboard 13, a power button 14 for powering on/off the computer 10 and a touch pad 16 are disposed on the upper surface of the main body 11. A first wireless communication module and a second wireless communication module are provided within the main body 11. The two (first and second) wireless communication modules are connected to the first antenna 1 and second antenna 2, via cables respectively. The first and second wireless communication modules execute wireless communication according to first and second wireless communication schemes. The first wireless communication scheme is, e.g. wireless LAN according to the IEEE 801.11 standard. The second wireless communication scheme is, e.g. UWB (ultra wideband).

In the wireless LAN, a frequency band of, e.g. 5 GHz is used. In the UWB, a frequency band of, e.g. 3.1 GHz to 10 GHz is used. Accordingly, the first antenna 1 covers the frequency band of 5 GHz. The first antenna 1 is thus designed to have at least a resonance frequency of, e.g. 5 GHz. The second antenna 2 is a wideband antenna which is configured to cover a frequency band of 3.1 GHz to 10 GHz.

The mounting position of the antenna 1, 2 is, for example, at an upper end portion of the display unit 12. The antennas are disposed at a relatively high position.

Figure 2:
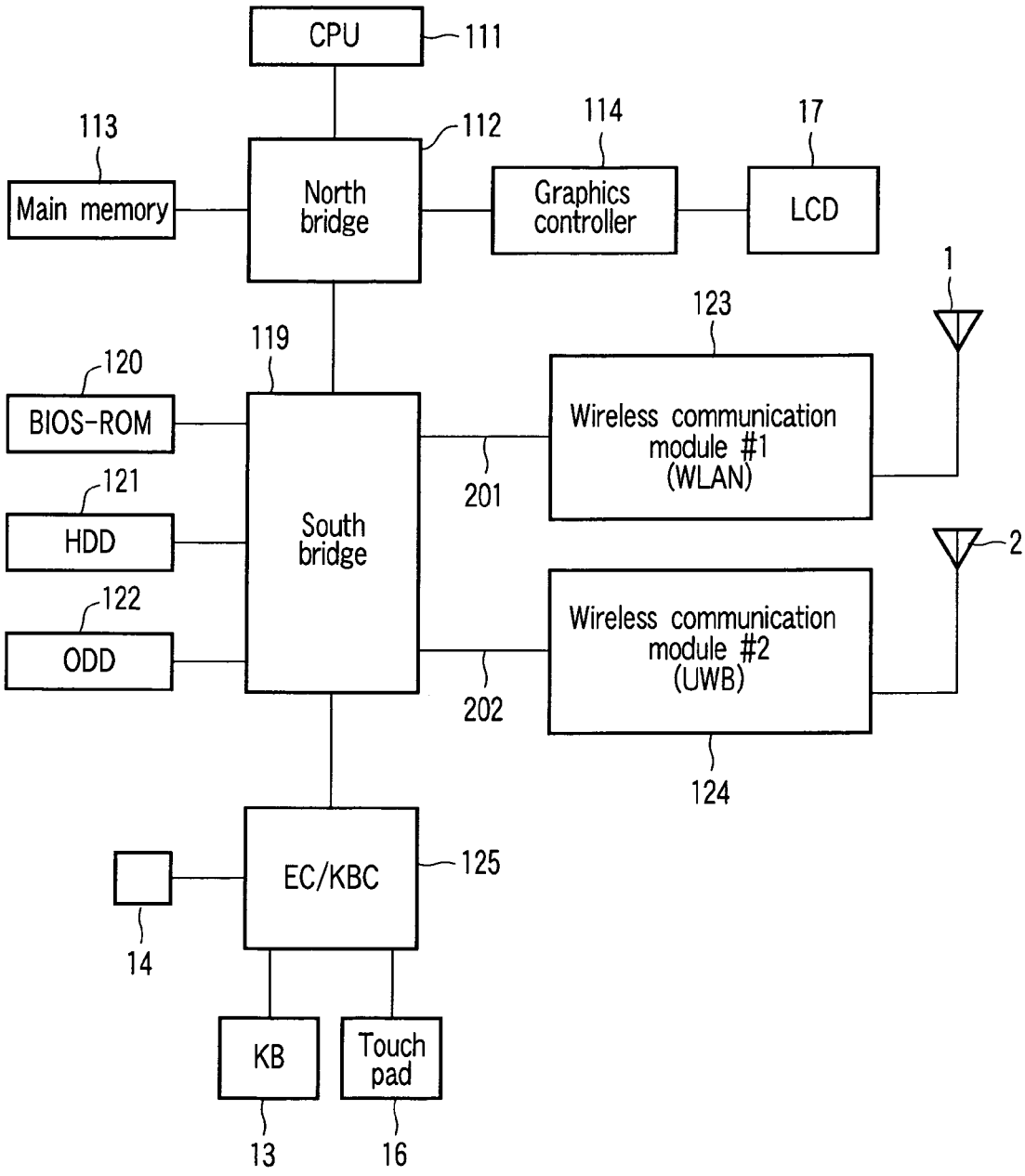
FIG. 2 is an exemplary block diagram showing a system configuration of the electronic apparatus according to the embodiment.

Next, referring to FIG. 2, the system configuration of the computer 10 is described.

The computer 10 comprises a CPU 111, a north bridge 112, a main memory 113, a graphics controller 114, a south bridge 119, a BIOS-ROM 120, a hard disk drive (HDD) 121, an optical disc drive (ODD) 122, a first wireless communication module 123, a second wireless communication module 124, and an embedded controller/keyboard controller IC (EC/KBC) 125.

The CPU 111 is a processor that controls the operation of the computer 10. The CPU 111 executes an operating system (OS) and various application programs, which are loaded from the hard disk drive (HDD) 121 into the main memory 113. The CPU 111 also executes a system BIOS (Basic Input/Output System) that is stored in the BIOS-ROM 120.

The north bridge 112 is a bridge device that connects a local bus of the CPU 111 and the south bridge 119. In addition, the north bridge 112 has a function of executing communication with the graphics controller 114 via, e.g. an AGP (Accelerated Graphics Port) bus.

The graphics controller 114 is a display controller which controls the flat-panel display (e.g. LCD) 17 that is used as a display monitor of the computer 10. The south bridge 119 is a bridge device which controls various I/O devices. The first wireless communication module 123 is connected to the south bridge 119 via a bus 201 such as a PCI Express bus. In addition, the second wireless communication module 124 is connected to the south bridge 119 via a bus 202 such as a PCI Express bus.

The embedded controller/keyboard controller IC (EC/KBC) 125 is a 1-chip microcomputer in which an embedded controller for power management and a keyboard controller for controlling the keyboard (KB) 13 and touch pad 16 are integrated.

The first wireless communication module 123 is connected to the antenna 1, and executes wireless communication according to a wireless communication scheme such as IEEE 801.11 standard. The second wireless communication module 124 is connected to the antenna 2, and executes wireless communication according to a wireless communication scheme such a UWB standard. A transmission power of the first wireless communication module 123 is higher than a transmission power of the second wireless communication module 124.

Figure 3:
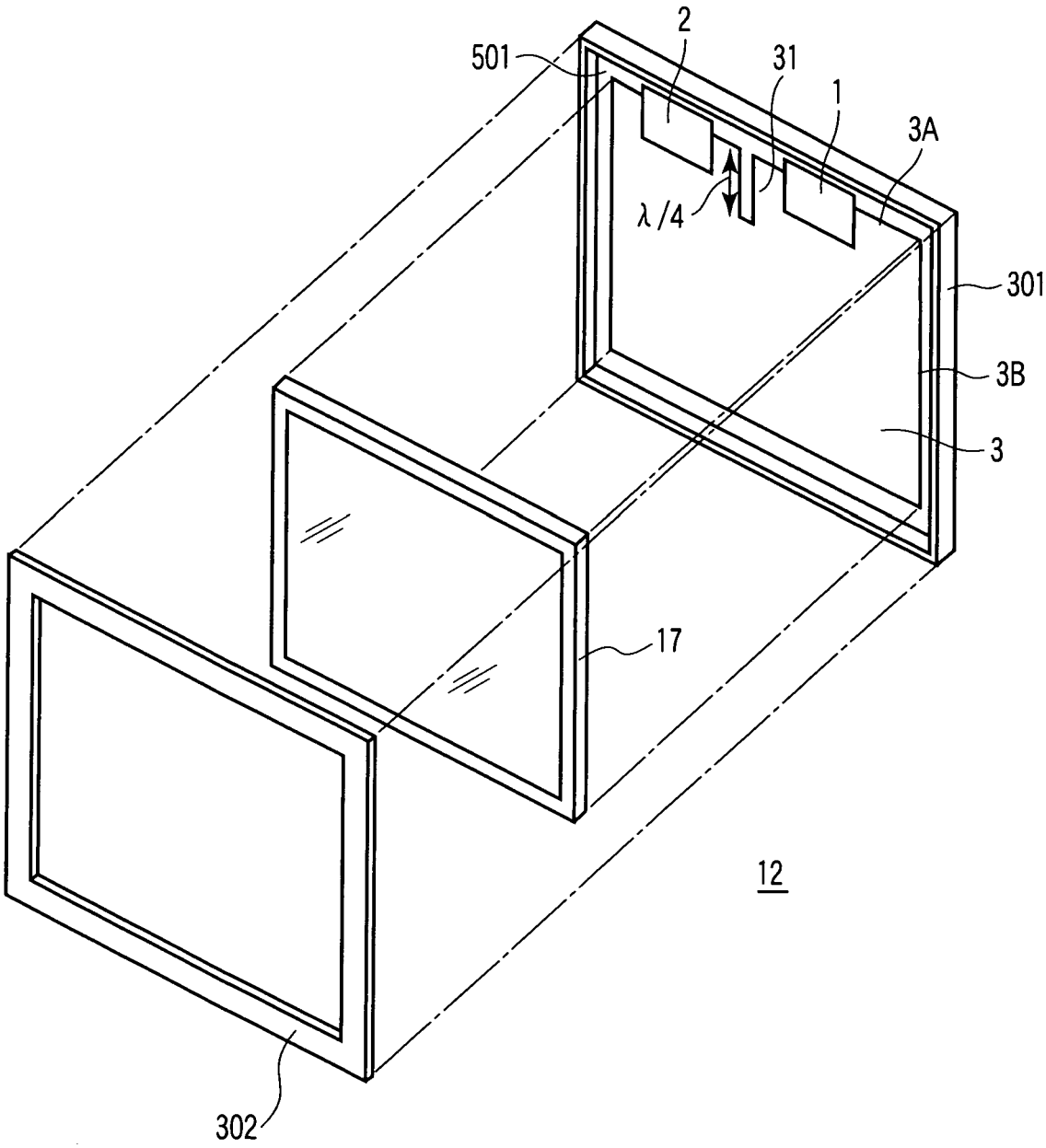
FIG. 3 is an exemplary exploded perspective view showing an example of the structure within the housing of the electronic apparatus according to the embodiment.
Figure 4:
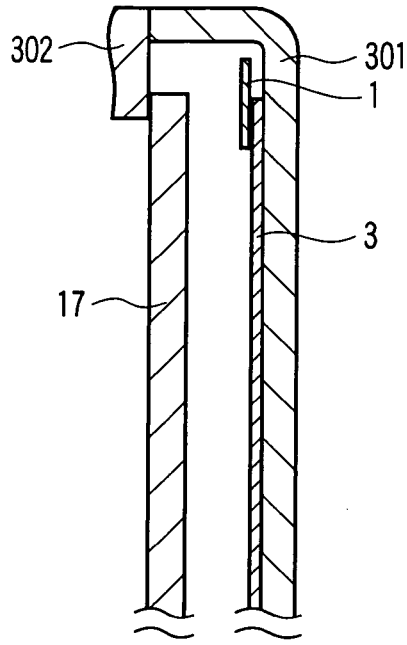
FIG. 4 is an exemplary cross-sectional view showing an example of the structure within the housing of the electronic apparatus according to the embodiment.

Next, referring to FIG. 3 and FIG. 4, the arrangement of the antennas 1 and 2 is specifically described.

FIG. 3 is an exploded perspective view showing an example of the structure of the display unit 12, and FIG. 4 shows an example of the cross-sectional structure of the display unit 12.

An electrically conductive layer 3 is formed on an inner surface 501 of the housing 301. The electrically conductive layer 3 has, for example, a rectangular shape. The electrically conductive layer 3 can be formed, for example, by coating an electrically conductive material, such as metal powder, on the inner surface 501 of the housing 301. The electrically conductive layer 3 shields an electromagnetic wave and prevents electromagnetic noise (EMI), which is radiated from the flat panel display 17, from being emitted to the outside of the housing 301.

The flat-panel display 17 is accommodated in the housing 301 in such a manner that the back surface of the flat-panel display 17 is opposed to the electrically conductive layer 3.

The antennas 1 and 2 are disposed between the back surface of the flat-panel display 17 and the surface of the electrically conductive layer 3. Specifically, the antenna 1 is disposed on the surface of the electrically conductive layer 3 such that a part of the antenna 1 is located more on an outer peripheral side than a side of the conductive layer 3 (i.e. an edge of the conductive layer 3). In this case, the antenna 1 is attached to the surface of the electrically conductive layer 3 by using an adhesive film, for example. A part of the antenna 1 projects to the outer peripheral side of the conductive layer 3 from the side of the conductive layer 3.

Similarly, the antenna 2 is disposed on the surface of the electrically conductive layer 3 such that a part of the antenna 2 is located more on an outer peripheral side than a side of the conductive layer 3. The antenna 2 is also attached to the surface of the electrically conductive layer 3 by using an adhesive film, for example. A part of the antenna 2 projects to the outer peripheral side of the conductive layer 3 from the side of the conductive layer 3.

Since a part of each of the antennas 1 and 2 is located more on the outer peripheral side than a side of the conductive layer 3, each of the antennas 1 and 2 is opposed both to the electrically conductive layer 3 and to a region on the inner surface 501 of the housing 301, where the conductive layer 3 is not formed. Therefore, although each of the antennas 1 and 2 is disposed on the surface of the electrically conductive layer 3 that is the electromagnetic wave shield layer for the flat-panel display 17, the performance of each of the antennas 1 and 2 does not deteriorate.

In addition, the electrically conductive layer 3 includes a notch (slit) 31 having a thin line shape. The notch 31 is formed in a predetermined position of one side (an outer edge) of the electrically conductive layer 3, the predetermined position is located between the antenna 1 and antenna 2. Specifically, the position where the notch 31 is formed is on a side connecting the antenna 1 and antenna 2 with a shortest distance. The notch 31 has a length (depth) equal to ¼ of a wavelength λ which corresponds to the resonance frequency (e.g. 5 GHz) of the antenna 1. In other words, the length of the notch 31 is 0.25λ.

The ideal length of the notch 31 is 0.25λ, but a length within 0.2λ to 0.3λ is acceptable. By the notch 31, an RF signal (e.g. a radio frequency signal of, e.g. 5 GHz) from the antenna 1 can be prevented from being propagated to the antenna 2 via the electrically conductive layer 3. The power of a signal, which is radiated from the antenna 1, is higher than the power of a signal which is radiated from the antenna 2. Thus, by setting the length of the notch 31 at ¼ of the wavelength λ corresponding to the resonance frequency (e.g. 5 GHz) of the antenna 1 and suppressing propagation of the RF signal (with a frequency of, e.g. 5 GHz, at which interference is prevented) from the antenna 1 to the antenna 2, the interference between the antennas 1 and 2 can be reduced significantly. In addition, by the notch 31, the propagation of the RF signal (with a frequency of, e.g. 5 GHz, which is an object of prevention of interference) from the antenna 2 to the antenna 1 can also be prevented. Therefore, adequate isolation between the antennas 1 and 2 can be ensured.

FIG. 3 shows the case in which both the antennas 1 and 2 are disposed along an upper side 3A of the electrically conductive layer 3. In this case, the notch 31 is formed in a predetermined position of the upper side 3A, which is located between the antenna 1 and antenna 2.

For example, one of the antennas 1 and 2 may be disposed on the upper side 3A, and the other may be disposed on a lateral side 3B.

Figure 5:
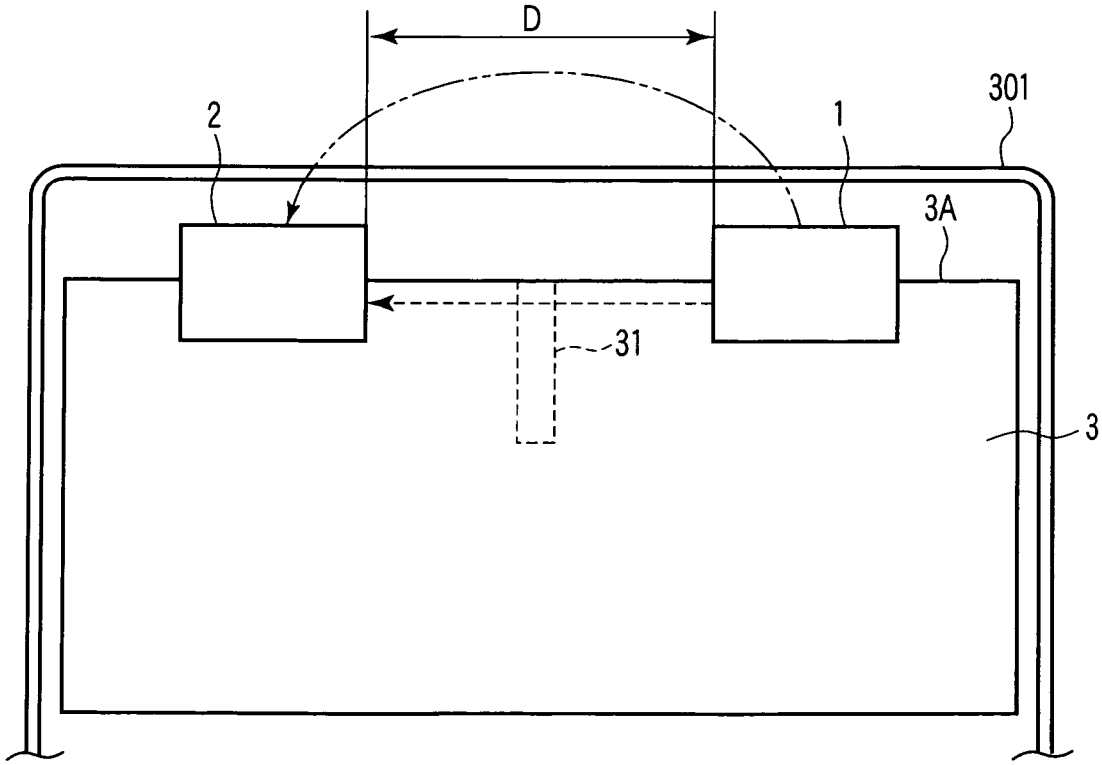
FIG. 5 is an exemplary view for explaining inter-antenna interference in the electronic apparatus according to the embodiment.

Next, referring to FIG. 5, the mechanism of interference between the antennas 1 and 2 is explained.

As is shown in FIG. 5, such a case is now assumed that the antennas 1 and 2 are disposed on the upper side 3A of the electrically conductive layer 3 in the state in which the antennas 1 and 2 are spaced apart by a distance D.

As described above, since the frequency band that is covered by the antenna 1 overlaps the frequency band that is covered by the antenna 2, the interference of radio waves occurs between the antennas 1 and 2. This interference adversely affects the wireless communication performances of the antennas 1 and 2. Since the transmission power of the antenna 1 is higher than that of the antenna 2, a wireless signal that is sent from the antenna 1 adversely affects the performance of wireless communication (UWB) that is executed by the using the antenna 2. It is thus necessary to secure sufficient isolation between the antenna 1 and antenna 2. The isolation indicates the degree of electromagnetic insulation between the antenna 1 and antenna 2.

The factors which determine the level of isolation include a signal (indicated by a two-dot-and-dash line) that is propagated from the antenna 1 to antenna 2 via a space, a signal (indicated by a broken line) that is propagated from the antenna 1 to antenna 2 via the electrically conductive layer 3 on the inner surface of the housing 301, and a signal that is propagated from the antenna 1 to antenna 2 via the flat-panel display 17.

If the notch 31 is not provided in the electrically conductive layer 3, a radio-frequency current (e.g. 5 GHz) flows from the antenna 1 to the antenna 2 via the surface of the conductive layer 3. This current flows along the side of the conductive layer 3.

In the present embodiment, the current flowing from the antenna 1 to antenna 2 via the upper side 3A of the electrically conductive layer 3 can greatly be reduced by the notch 31. The notch 31 is provided in a predetermined portion of the side (upper side 3A) of the conductive layer 3, and is located between the antenna 1 and antenna 2.

Figure 6:
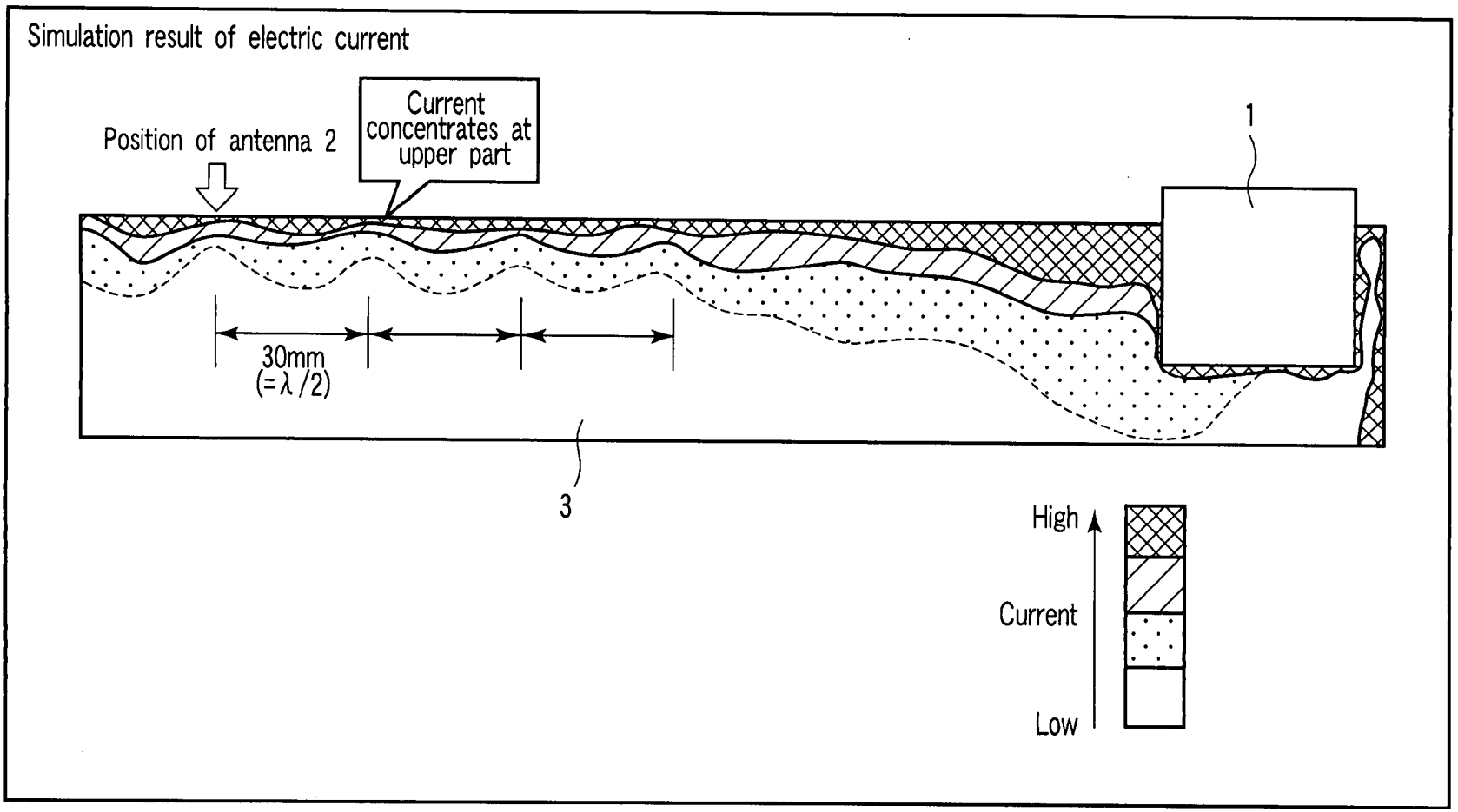
FIG. 6 is an exemplary view showing a simulation result of an electric current flowing via an electrically conductive layer which is provided in the electronic apparatus according to the embodiment.

FIG. 6 shows a simulation result of the amount of an electric current flowing from the antenna 1 to antenna 2 via the surface of the electrically conductive layer 3.

This simulation was conducted by using an FDTD (Finite Difference Time Domain) method, which is an example of an electromagnetic field analysis method, and a moment method. It was assumed that the resonance frequency of the antenna 1, that is, the frequency of radio waves emitted from the antenna 1, was 5 GHz in this simulation.

As is understood from the simulation result shown in FIG. 6, the electric current flows along the side of the electrically conductive layer 3. In this case, the amount of current is large at the side and the edge. In addition, as is understood from the simulation result shown in FIG. 6, the intensity of electric current cyclically varies (occurrence of standing wave). The frequency of the standing wave is equal to the resonance frequency of the antenna 1 (5 GHz in this example). Thus, by disposing the antenna 2 at a position apart from the antenna 1 by a distance corresponding to a predetermined integer number of times of the length of ½ of the wavelength λ that corresponds to the resonance frequency of the antenna 1, the position of the antenna 2 can be made to agree with a dip portion of the standing wave. In other words, in this embodiment, the distance (D in FIG. 5) between the antenna 1 and antenna 2 is set to be a predetermined integer number of times of the length of ½ of the wavelength λ that corresponds to the resonance frequency of the antenna 1 (the frequency at which interference is to be reduced).

Figure 7:
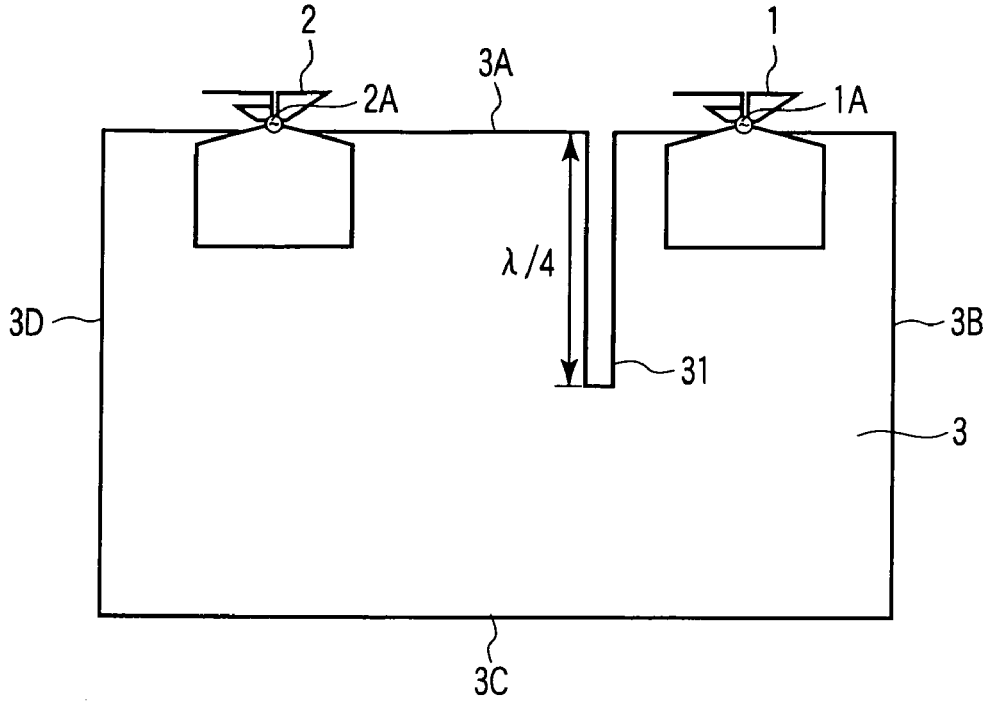
FIG. 7 shows a first example of the antenna arrangement which is applied to the electronic apparatus according to the embodiment.

Next, referring to FIG. 7, an example of specific disposition of antennas 1 and 2 is described.

FIG. 7 shows an example in which the antennas 1 and 2 are disposed on the upper side 3A of the electrically conductive layer 3.

Each of the antennas 1 and 2 can be realized by, for instance, a dipole antenna or a monopole antenna. In FIG. 7 it is assumed that each of the antennas 1 and 2 is realized as a dipole antenna having two antenna elements.

A Part of the antenna 1 (for example, a power feed point 1A of the antenna 1 and one of the antenna elements of the antenna 1) is located more on the outer peripheral side than the upper side 3A of the electrically conductive layer 3 so that the part of the antenna 1 is opposed to a region on the inner surface 501 of the housing 301, where the conductive layer 3 is not formed (i.e. an outer peripheral side region of the conductive layer 3). In other words, the part of the antenna 1 projects to the outer peripheral side from the upper side 3A of the electrically conductive layer 3. The other antenna element of the antenna 1 (planar antenna element) is disposed on the surface of the electrically conductive layer 3 via, e.g. an adhesive layer so as to be opposed to the surface of the conductive layer 3.

Similarly, a part of the antenna 2 (for example, a power feed point 2A of the antenna 2 and one of the antenna elements of the antenna 2) is located more on the outer peripheral side than the upper side 3A of the electrically conductive layer 3 so that the part of the antenna 2 is opposed to a region on the inner surface 501 of the housing 301, where the conductive layer 3 is not formed (i.e. an outer peripheral side region of the conductive layer 3). In other words, the part of the antenna 2 projects to the outer peripheral side from the upper side 3A of the electrically conductive layer 3. The other antenna element of the antenna 2 (planar antenna element) is disposed on the surface of the electrically conductive layer 3 via, e.g. an adhesive layer so as to be opposed to the surface of the conductive layer 3.

As described above, as regards the antenna 1, parts of the antenna 1 including the power feed point 1A project from the electrically conductive layer 3. Similarly, as regards the antenna 2, parts of the antenna 2 including the power feed point 2A project from the electrically conductive layer 3. Therefore, even if the antennas 1 and 2 are disposed on the electrically conductive layer 3, the performances of the antennas 1 and 2 are not degraded.

Figure 8:
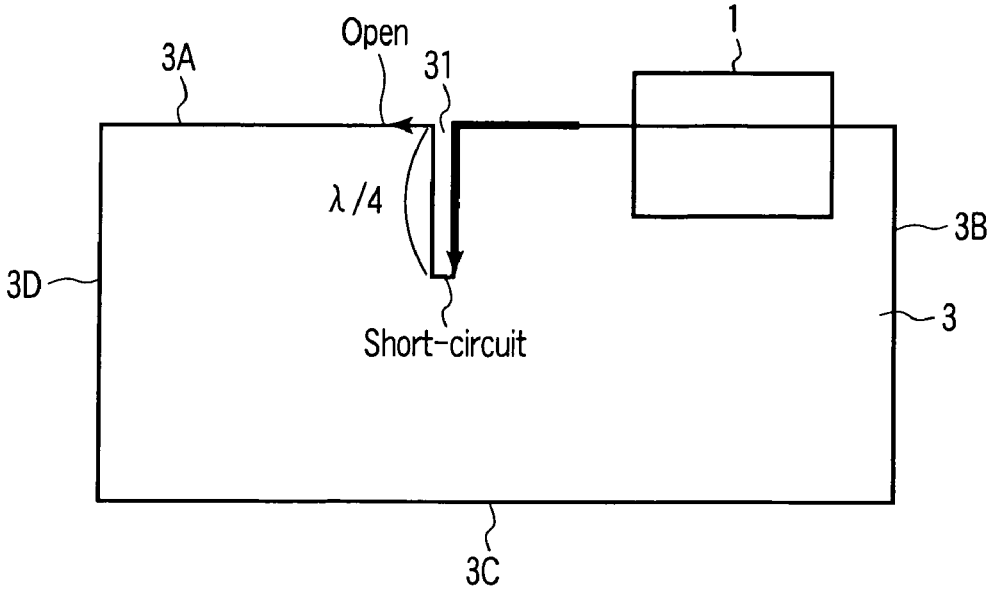
FIG. 8 is an exemplary view for explaining a function by a notch which is formed in the electrically conductive layer provided in the electronic apparatus according to the embodiment.

A notch (slit) 31 is formed in a predetermined position of the upper side 3A between the antennas 1 and 2. The notch 31 extends in a direction perpendicular to the side 3A, that is, the notch 31 extends from the upper side 3A toward a lower side 3C. The length of the notch 31 is set at a length of ¼ of the wavelength λ which corresponds to the frequency at which interference is to be prevented (the resonance frequency of the antenna 1, e.g. 5 GHz). The length of the notch 31 is ideally 0.25λ, but it may be in a range of about 0.2λ to 0.3λ. The notch 31 efficiently prevents a radio-frequency current (e.g. 5 GHz) from the antenna 1 from flowing into the antenna 2 along the side 3A. Specifically, as shown in FIG. 8, with the formation of the notch 31 at the upper side 3A, the impedance at the bottom side of the notch 31 is short-circuited, but the impedance of the upper side 3A, which is away from the bottom side of the notch 31 by λ/4, is opened. Thus, the flow of electric current can be suppressed, and as a result the isolation between the antennas can be improved.

Figure 9:
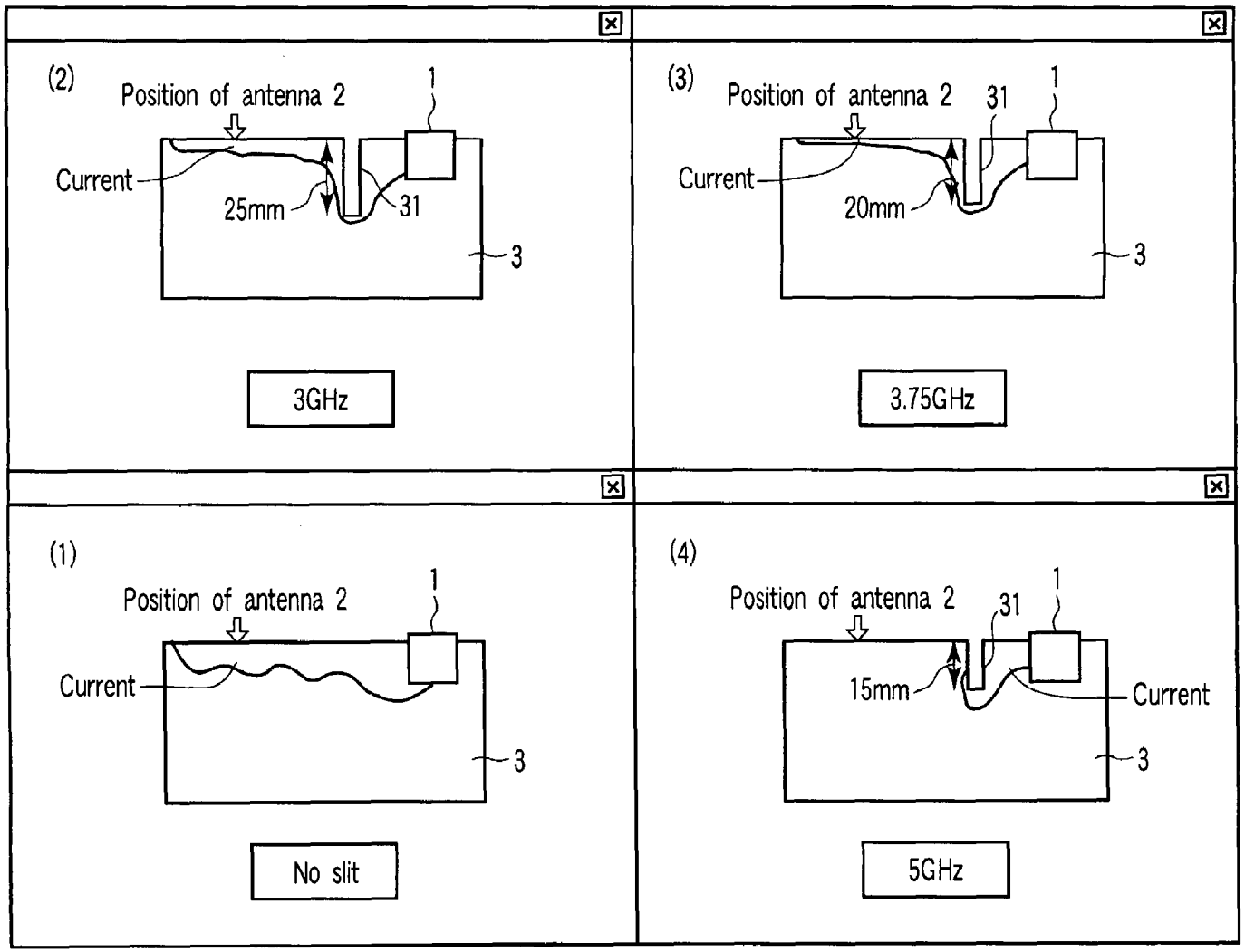
FIG. 9 is an exemplary view showing four simulation results of an electric current flowing via an electrically conductive layer which is provided in the electronic apparatus according to the embodiment.

FIG. 9 shows a simulation result of the amount of a radio-frequency electric current obtained when the length of the notch 31 was varied. This simulation was also conducted by using the above-described FDTD (Finite Difference Time Domain) method and moment method. In this simulation, it was assumed that the resonance frequency of the antenna 1 was 5 GHz.

In FIG. 9, part (1) shows a simulation result in a case where the notch (slit) 31 is not provided, part (2) shows a simulation result in a case where the length of the notch 31 is 25 mm, part (3) shows a simulation result in a case where the length of the notch 31 is 20 mm, and part (4) shows a simulation result in a case where the length of the notch 31 is 15 mm. From the simulation results, it is understood that in the case where the length of the notch 31 is 15 mm, that is, in the case where the length of the notch 31 is ¼ of the wavelength λ corresponding to the resonance frequency (5 GHz) of the antenna 1, the radio-frequency current of 5 GHz can most be reduced.

Next, a measurement result of the relationship between the width (slit width) of the notch (slit) 31 and the isolation will be described.

Figure 10:
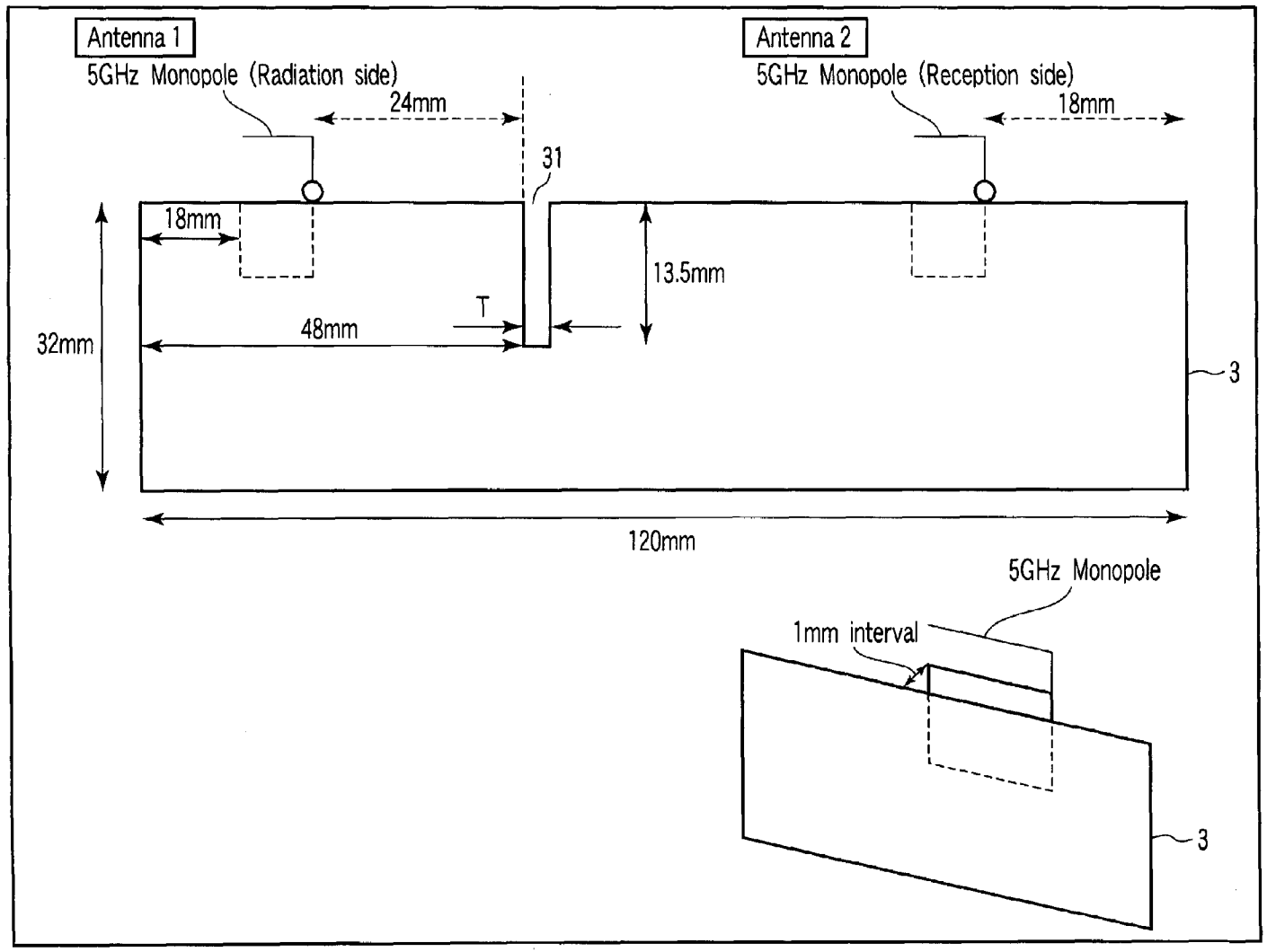
FIG. 10 is an exemplary view for explaining measurement conditions used for measuring the relationship between the width of a notch and isolation, the notch being formed in the electrically conductive layer provided in the electronic apparatus according to the embodiment.

FIG. 10 shows conditions for measurement. 5 GHz monopole antennas were used as the above-described antennas 1 and 2. The size of a metal plate, which simulates the electrically conductive layer 3, is 120 mm in horizontal length and 32 mm in vertical length. One of the 5 GHz monopole antennas (antenna 2) is disposed at a position that is 18 mm away from the right end of the metal plate, and the other 5 GHz monopole antenna (antenna 1) is disposed at a position that is 18 mm away from the left end of the metal plate. The notch (slit) 31 is formed at a position that is 24 mm away from the antenna 1 to the right side, and the notch is 48 mm away from the left end of the metal plate. The maximum radiation efficiency of each 5 GHz monopole antenna is 5.5 GHz. Thus, the length of the notch 31 was set at 13.5 mm which is ¼ of the wavelength corresponding to 5.5 GHz. In addition, the distance between each of the antennas 1 and 2 and the surface of the metal plate was 1 mm.

Figure 11:
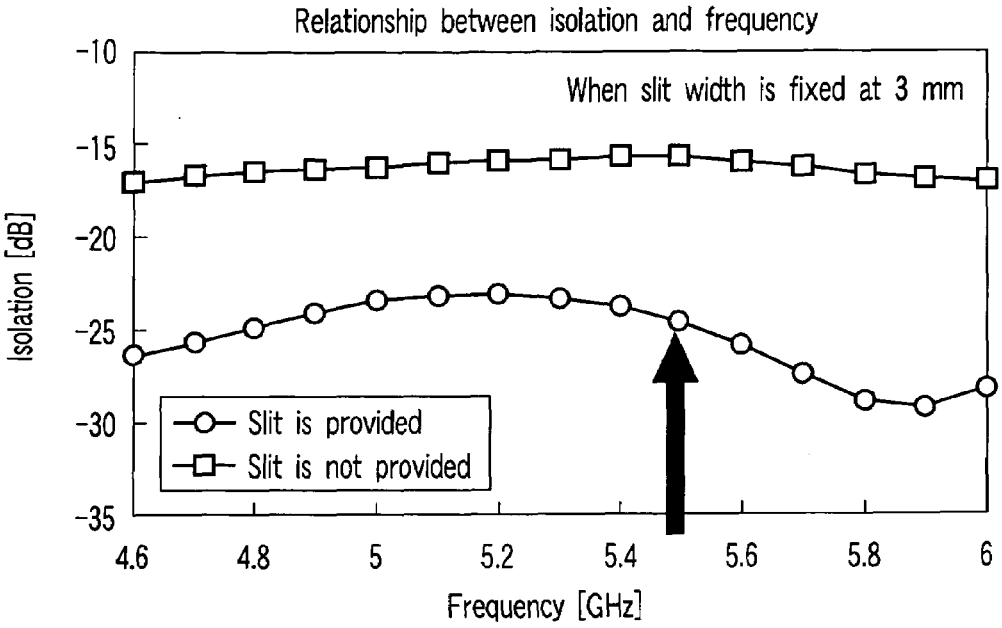
FIG. 11 is an exemplary view showing a measurement result of frequency characteristics of isolation.

FIG. 11 shows a measurement result of frequency characteristics of isolation. In analysis, it is assumed that the antenna 1 is a radiation source, and the antenna 2 is a reception side. The ratio of power S2, which is received by the antenna 2, to power S1, which is radiated from the antenna 1, is an isolation value, and this numerical value S2/S1 is indicated as a decibel value. In this case, the width of the notch 31 (slit width T) is fixed at 3 mm. It is understood that better isolation is obtained in the case where the notch (slit) 31 is provided, than in the case where the notch (slit) 31 is not provided.

Figure 12:
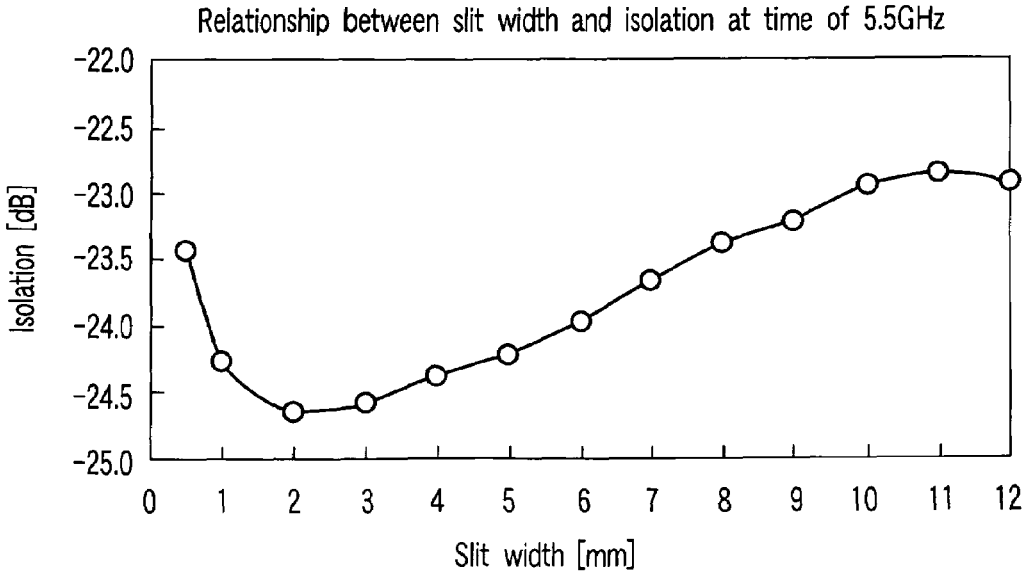
FIG. 12 is an exemplary view showing a measurement result of the relationship between the width of a notch, which is formed in the electrically conductive layer provided in the electronic apparatus according to the embodiment, and isolation.

FIG. 12 shows a measurement result between the slit width T and the isolation.

The measurement of the isolation was conducted while the slit width T was varied in the range of 0.5 mm to 12 mm. Although the isolation varies in accordance with the variation of the slit width T, practically adequate isolation can be secured if the slit width T is in the range of about 0.5 mm to about 12 mm.

As has been described above, the width of the notch 31 is not strictly limited, and adequate isolation can be secured in a wide range of about 0.5 mm to about 12 mm. Hence, the width of the notch 31 may be set, for example, in such a relatively narrow range that the function of the electrically conductive layer 3 as the electromagnetic wave shield layer would not be degraded.

The shape of each of the antennas 1 and 2 is not limited to the shape shown in FIG. 7, and each of the antennas 1 and 2 may be in a planar shape as shown in FIG. 5.

Figure 13:
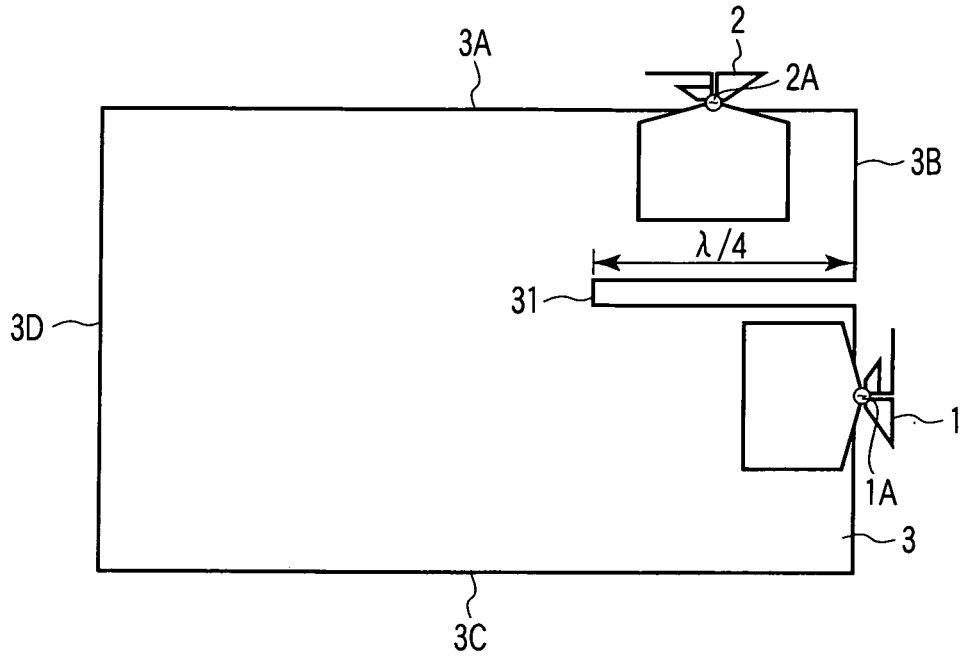
FIG. 13 shows a second example of the antenna arrangement which is applied to the electronic apparatus according to the embodiment.

FIG. 13 shows an example in which antennas 1 and 2 are disposed on a lateral side 3B and an upper side 3A of the electrically conductive layer 3. In this example, a description is given of only parts which are different from the structure of FIG. 7.

A notch 31 is formed, for example, in a predetermined part in the lateral side 3B, which is located between the antenna 1 and antenna 2. The notch 31 extends from the lateral side 3B toward a lateral side 3D. The length of the notch 31 is set at a length of ¼ of the wavelength λ corresponding to the frequency at which interference is prevented (the resonance frequency of the antenna 1, for example, 5 GHz). The ideal length of the notch 31 is 0.25λ, but it may be about 0.2λ to 0.3λ. In this structure, a radio-frequency current from the antenna 1 can be prevented from flowing into the antenna 2 along the lateral side 3B by the notch 31.

Figure 14:
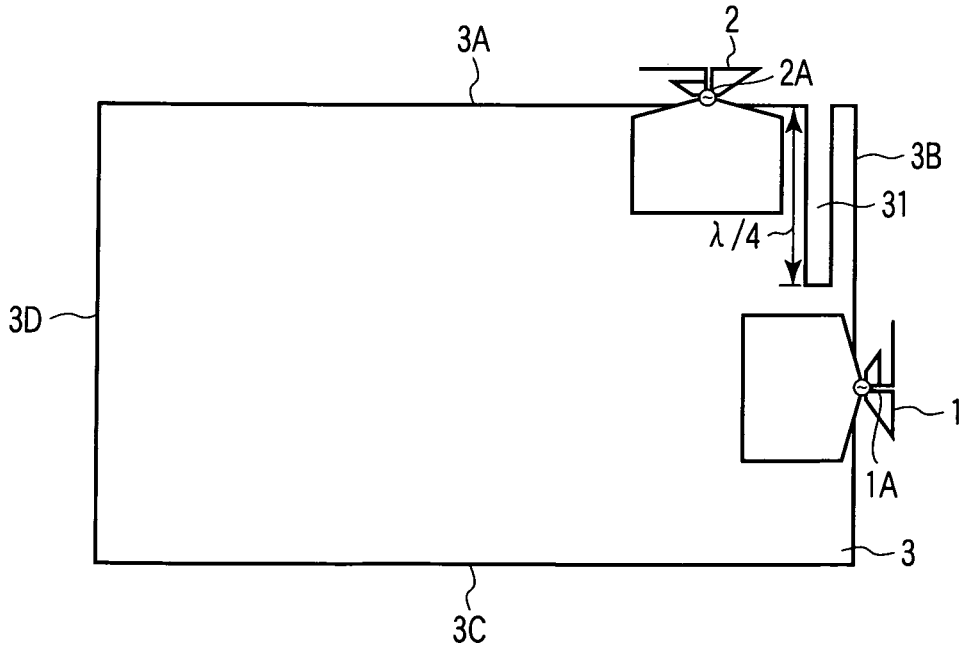
FIG. 14 shows a third example of the antenna arrangement which is applied to the electronic apparatus according to the embodiment.

As shown in FIG. 14, the notch 31 may be formed in a predetermined part of the upper side 3A, which is located between the antenna 1 and antenna 2.

Figure 15:
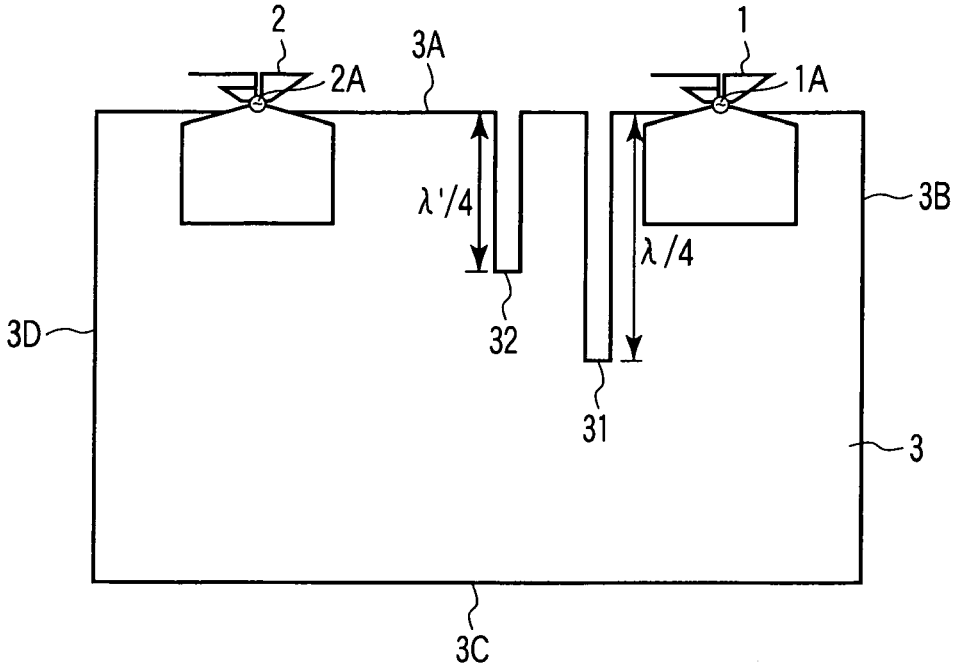
FIG. 15 shows a fourth example of the antenna arrangement which is applied to the electronic apparatus according to the embodiment.

FIG. 15 shows an example of antenna arrangement, which is adaptable to a case where there are two interference frequencies. In this example, a description is given of only parts which are different from the structure of FIG. 7.

In a case where the antenna 1 is composed of a wide-band antenna (also called "multi-band antenna") which covers a plurality of frequency bands, each of a plurality of resonance frequencies of the antenna 1 may adversely affect the performance of wireless communication which is executed with use of the antenna 2.

For example, assume a case in which the antenna 1 has another resonance frequency (e.g. 7 GHz) in addition to the above-described resonance frequency (e.g. 5 GHz). These two resonance frequencies (e.g. GHz and 7 GHz) of the antenna 1 fall within a frequency band that is covered by the antenna 2. Thus, each of the two resonance frequencies (e.g. 5 GHz and 7 GHz) of the antenna 1 becomes a frequency at which interference is to be prevented. In this case, two notches 31 and 32, which correspond to the two resonance frequencies, are formed in the electrically conductive layer 3.

Specifically, the antennas 1 and 2 are disposed on the upper side 3A of the electrically conductive layer 3. In this case, two notches 31 and 32 are formed in the upper side 3A of the electrically conductive layer 3, which is located between the antennas 1 and 2. The length of the notch 31 is set at a length of ¼ of the wavelength λ corresponding to the frequency at which interference is to be prevented (one of the two resonance frequencies, for example, 5 GHz). By the presence of the notch 31, a radio-frequency current (e.g. 5 GHz) from the antenna 1 can efficiently be prevented from flowing into the antenna 2 via the electrically conductive layer 3. On the other hand, the length of the notch 32 is set at a length of ¼ of the wavelength λ' corresponding to the frequency at which interference is to be prevented (the other resonance frequency, for example, 7 GHz). By the presence of the notch 32, a radio-frequency current (e.g. 7 GHz) from the antenna 1 can efficiently be prevented from flowing into the antenna 2 via the electrically conductive layer 3.

Next, an example of the shape of the notch 31 is described with reference to FIG. 16. A description is given of only parts which are different from the structure of FIG. 7.

As described above, the electrically conductive layer 3 functions as an electromagnetic wave shield layer for preventing EMI noise, which is radiated from the flat-panel display 17, from being emitted to the outside of the housing 301. Normally, the amount of EMI noise is not uniform radiation over the entire panel of the flat-panel display 17. For example, the amount of EMI noise is small at the upper end side of the panel of the flat-panel display 17, and the amount of EMI noise gradually increases toward the lower end side. One reason for this is that a driver circuit for driving the flat-panel display 17 is provided near the lower end of the panel of the flat-panel display 17.

Figure 16:
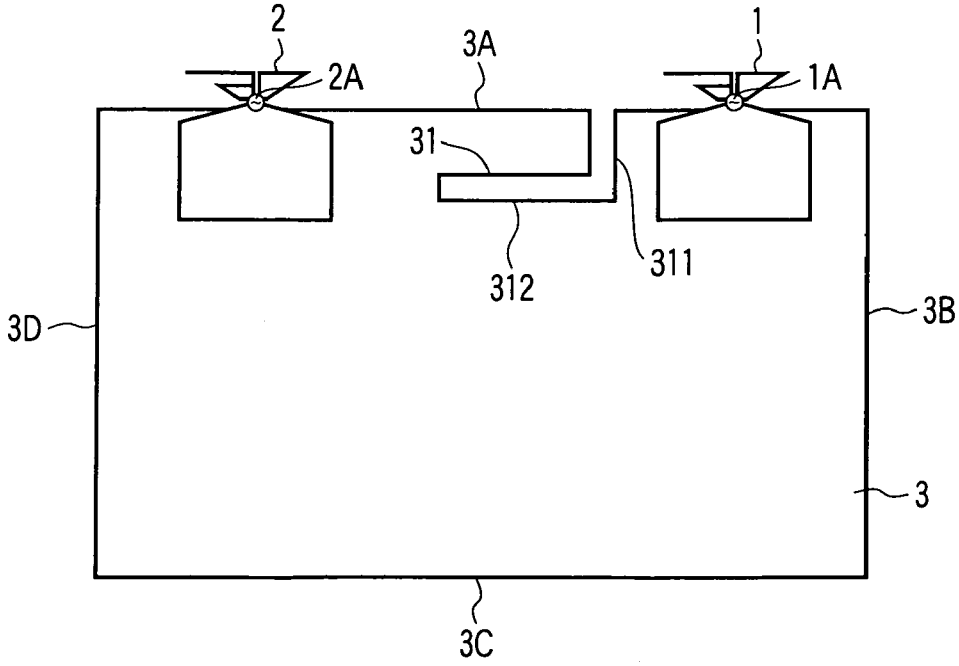
FIG. 16 shows an example of the shape of a notch which is formed in the electrically conductive layer provided in the electronic apparatus according to the embodiment.

Thus, in the example of FIG. 16, a notch 31 with a bent shape is formed at the upper side 3A so that an area, where a part of the electrically conductive layer 3 is removed, may fall, as much as possible, within a range near the upper side 3A of the electrically conductive layer 3. Specifically, the notch 31 includes a first notch portion 311 extending from a predetermined part on the upper side 3A toward the lower side 3C, and a second notch portion 312 extending from an end of the first notch portion 311 toward the lateral side 3D. The length of the notch 31 is the total length of the first notch portion 311 and second notch portion 312, and is ¼ of the wavelength λ corresponding to the frequency at which interference is to be prevented (the resonance frequency of the antenna 1, for example, 5 GHz). The ideal total length of the first notch portion 311 and second notch portion 312 is 0.25λ, but a total length of 0.2λ to 0.3λ is acceptable. Since the width of the notch 31 is very small, a difference in length between an outer side of the notch 31 and an inner side of the notch 31 is small and can be considered as falling within an error range.

In the present embodiment described above, the antennas 1 and 2 are disposed between the electrically conductive layer 3 (which functions as an electromagnetic wave shield layer for the flat-panel display 17) and the back surface of the flat-panel display 17. Therefore, there is no need to provide a dedicated space for mounting the antennas 1 and 2 within the housing 301, and the housing 301 can be reduced in size and thickness. In addition, each antenna 1, 2 is disposed on the surface of the electrically conductive layer 3 so that a part thereof projects from a side of the conductive layer 3. Therefore, the performance of the antenna 1, 2 does not deteriorate. Moreover, the length of the notch 31 (which is formed at a predetermined position on a side of the electrically conductive layer 3 located between the antenna 1 and antenna 2) is set at a length of ¼ of the wavelength λ corresponding to the frequency at which interference is to be prevented (the resonance frequency of the antenna 1, e.g. 5 GHz). Therefore, adequate isolation can be secured between the antennas 1 and 2.

In the above description, the electronic apparatus of the present embodiment is a notebook-type computer. Alternatively, the electronic apparatus of the embodiment may be a PDA, as shown in FIG. 17.

Figure 17:
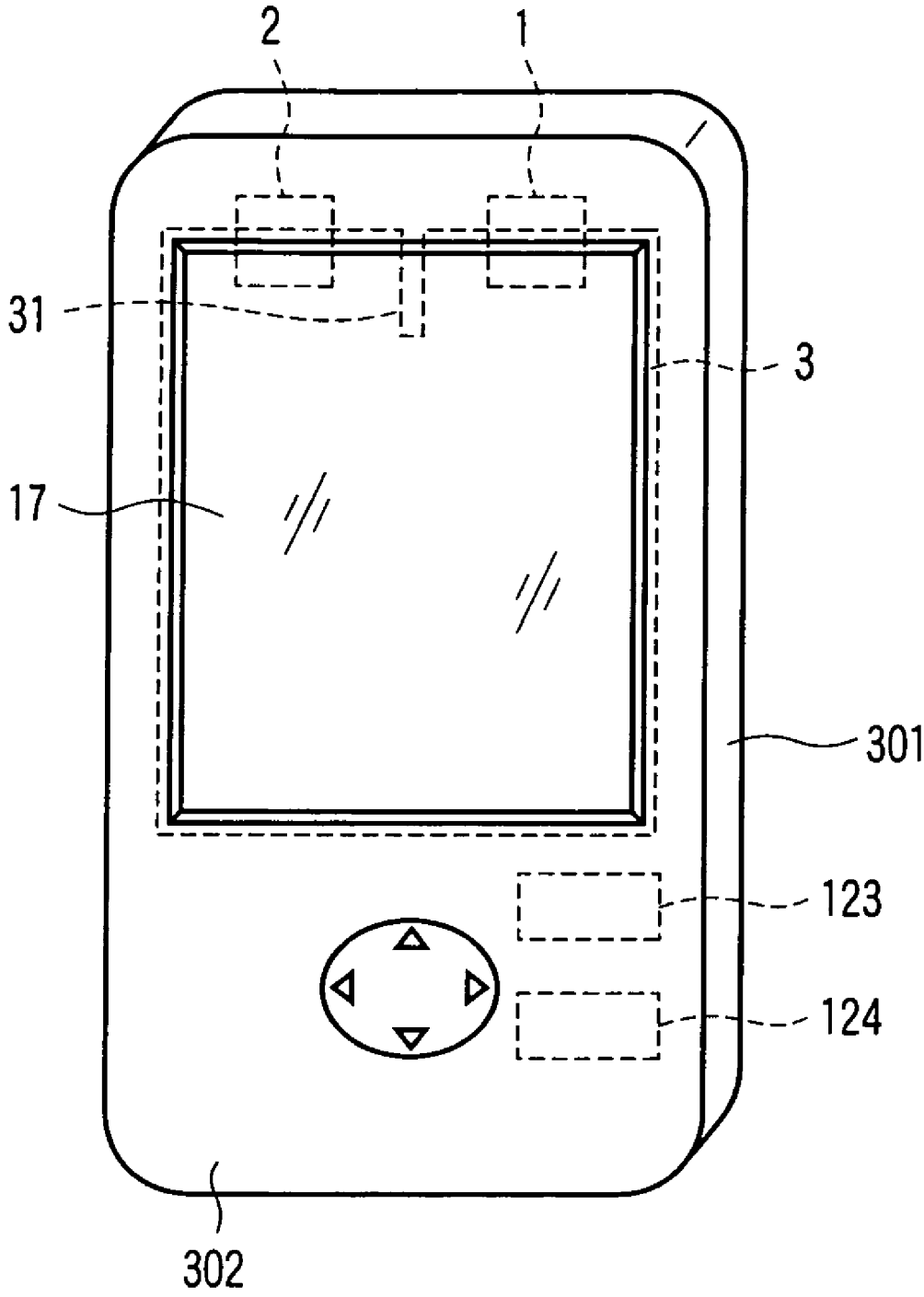
FIG. 17 is an exemplary perspective view showing another example of the structure of the electronic apparatus according to the embodiment.

In FIG. 17, a housing 301 of the PDA includes not only the antennas 1 and 2, electrically conductive layer 3 in which the notch 31 is formed, and flat-panel display 17, but also all the other components including wireless communication modules 123 and 124.

As in the case of this example, the housing 301 is usable as a housing for accommodating all components that constitute the electronic apparatus.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An electronic apparatus comprising:

a housing in which an electrically conductive layer is formed on an inner surface of the housing;

a flat-panel display which is accommodated in the housing, with a back surface of the flat-panel display being opposed to the electrically conductive layer;

a first antenna which is disposed on the electrically conductive layer, a part of the first antenna being located more on an outer peripheral side than a side of the electrically conductive layer; and a second antenna which is disposed on the electrically conductive layer, a part of the second antenna being located more on the outer peripheral side than the side of the electrically conductive layer, wherein the electrically conductive layer includes a notch formed in a predetermined portion of a side of the electrically conductive layer, which is located between the first antenna and the second antenna, the notch having a length of ¼ of a wavelength corresponding to a resonance frequency of the first antenna.

2. The electronic apparatus according to claim 1, wherein the first antenna further has another resonance frequency, and the electrically conductive layer further includes another notch which is formed in a predetermined position on the side, that is located between the first antenna and the second antenna, said another notch having a length of ¼ of a wavelength corresponding to said another resonance frequency of the first antenna.

3. The electronic apparatus according to claim 1, further comprising:

a first wireless communication module which is electrically connected to the first antenna and executes wireless communication by a first wireless communication scheme; and a second wireless communication module which is electrically connected to the second antenna and executes wireless communication by a second wireless communication scheme.

4. The electronic apparatus according to claim 3, wherein a transmission power of the first wireless communication module is higher than a transmission power of the second wireless communication module.

5. The electronic apparatus according to claim 1, wherein a distance between the first antenna and the second antenna is an integer number of times of the length of ¼ of the wavelength which corresponds to the resonance frequency of the first antenna.

6. The electronic apparatus according to claim 1, wherein the electrically conductive layer is formed in a rectangular shape, the first antenna and the second antenna are disposed on an upper side of the electrically conductive layer, and the notch is formed in a predetermined position of the upper side, which is located between the first antenna and the second antenna.

7. The electronic apparatus according to claim 6, wherein the notch includes a first notch portion extending from the predetermined position on the upper side toward a lower side of the electrically conductive layer, and a second notch portion extending from an end of the first notch portion toward a lateral side of the electrically conductive layer.

8. The electronic apparatus according to claim 6, wherein the first antenna further has another resonance frequency, and the electrically conductive layer further includes another notch which is formed in a predetermined position of the upper side, that is located between the first antenna and the second antenna, said another notch having a length of ¼ of a wavelength corresponding to said another resonance frequency of the first antenna.

9. The electronic apparatus according to claim 1, wherein the electrically conductive layer is formed in a rectangular shape, the first antenna is disposed on a lateral side of the electrically conductive layer, and the second antenna is disposed on an upper side of the electrically conductive layer, and the notch is formed in one of a predetermined position of the lateral side, which is located between the first antenna and the second antenna, and a predetermined position of the upper side, which is located between the first antenna and the second antenna.

* * * * *